US006544097B1

(12) United States Patent
Bain

(10) Patent No.: US 6,544,097 B1
(45) Date of Patent: Apr. 8, 2003

(54) TOY DOLLS WITH PROGRAMMABLE SPEECH AND ENCLOSURES THEREFOR

(76) Inventor: Cynthia Bain, 137 Scott Dr., Atlantic Beach, NY (US) 11509

( * ) Notice: Subject to any disclaimer, the term of this patent is extended or adjusted under 35 U.S.C. 154(b) by 0 days.

(21) Appl. No.: 09/637,142

(22) Filed: Aug. 11, 2000

Related U.S. Application Data

(60) Provisional application No. 60/148,449, filed on Aug. 11, 1999.

(51) Int. Cl.[7] ..... A63H 3/28
(52) U.S. Cl. ..... 446/297; 446/302
(58) Field of Search ..... 446/297, 298, 446/300, 301, 302

(56) References Cited

U.S. PATENT DOCUMENTS

| | | | | | |
|---|---|---|---|---|---|
| 2,433,540 | A | | 12/1947 | Wright | |
| 3,520,078 | A | | 7/1970 | Klamer | |
| 4,817,936 | A | | 4/1989 | Matsuda | |
| 4,964,831 | A | * | 10/1990 | Wolff | 446/75 |
| 5,209,345 | A | * | 5/1993 | Haugabook | 206/45.13 |
| 5,224,894 | A | | 7/1993 | Nelson et al. | |
| 5,376,038 | A | * | 12/1994 | Arad et al. | 446/297 |
| 5,545,069 | A | | 8/1996 | Glynn et al. | |
| 5,733,131 | A | * | 3/1998 | Park | 446/297 |
| 5,738,526 | A | * | 4/1998 | Cerda et al. | 446/297 |
| 5,947,474 | A | * | 9/1999 | Kanagawa | 446/297 |
| 6,007,404 | A | * | 12/1999 | Trevino | 446/297 |
| 6,074,212 | A | * | 6/2000 | Cogliano | 446/369 |
| 6,106,358 | A | * | 8/2000 | McKenzie | 446/229 |
| 6,149,490 | A | * | 11/2000 | Hampton et al. | 446/353 |
| 6,238,263 | B1 | * | 5/2001 | Bennett | 446/330 |

* cited by examiner

*Primary Examiner*—Jacob K. Ackun
*Assistant Examiner*—Faye Francis
(74) *Attorney, Agent, or Firm*—Mark D. Bowen, Esq.; Stearns Weaver Miller Weissler Alhadeff & Sitterson, P.A.

(57) ABSTRACT

A toy doll capable of playing preprogrammed speech. The doll body is in the form of a human infant and includes a head having human facial and head features, arms, legs and a torso. The doll body having a color characteristic, namely being of a uniform color selected from colors which are visually distinguishable from actual human skin colors. The doll further including: data storage means disposed within the doll body for storing a plurality of prerecorded audible speech phrases; audio output means including speaker means disposed within said doll body for playing said prerecorded audible speech phrases; processor control means disposed within said doll body, said processor control means electrically connected to each of said storage means and said audio output means, said processor control means including random data selection means for randomly selecting one of said plurality of prerecorded audible speech phrases; power supply means electrically connected to said processor control means; manual switch means having a portion thereof including a reflecting surface projecting from said doll body. The manual switch functioning to selectively activate said processor control means thereby causing the random selection and playing of at least one of said plurality of prerecorded audible speech phrases. A brightly colored egg-shaped enclosure with a removable portion provides a housing for removably containing the doll.

7 Claims, 7 Drawing Sheets

TOY DOLLS WITH PROGRAMMABLE SPEECH AND ENCLOSURES THEREFOR

CROSS REFERENCE TO RELATED APPLICATIONS

This application claims the benefit of provisional U.S. Patent Application Ser. No. 60/148,449, filed Aug. 11, 1999.

STATEMENT REGARDING FEDERALLY SPONSORED RESEARCH OR DEVELOPMENT

N.A.

BACKGROUND OF THE INVENTION

1. Field of the Invention

The present invention relates generally to toy dolls, and particularly to brightly colored toy "alien" dolls incorporating speech synthesis electronics and removably housed within correspondingly colored egg-shaped containers.

2. Description of the Background Art

Toy dolls provide children with countless hours of amusement and fun. For example, "BARBIE®" dolls and accessories manufactured by Mattel, Inc. have enjoyed widespread and substantial sales success over a large number of years. Dolls such as the BARBIE® doll provide children with enjoyable toys that stimulate the imagination.

Toy dolls are available in many forms including, human form, animal form, action figures, fantasy creatures and the like. Furthermore, most individuals familiar with the background art relating to toy dolls are familiar with well known dolls such as G.I. Joe, Elmo, Barney, Sebastian the Ibis, Big Bird, and Winney the Pooh, just to name a few. Other examples of toy dolls are shown in the following. U.S. Patents: U.S. Pat. No. 2,433,540 (Humpty Dumpty doll). U.S. Pat. No. 3,520,078, issued to Klamer, discloses a multicharactered toy having interchangeable parts and including an egg-shaped housing wherein individual parts can be stored. U.S. Pat. No. 4,817,936, issued to Matsuda, discloses a spring-powered toy contained within a divisible housing, which housing divides thereby allowing a windup toy character to emerge. U.S. Pat. No. 4,964,831, issued to Wolff, discloses a doll device including an egg-shaped outer housing within which is contained one or more dolls. Each doll comes with a story sheet(s) which details events in the life of the doll, and particularly, that event depicted on the painted face of the housing. U.S. Pat. No. 5,209,345, issued to Haugabook, discloses a combination storage and display unit comprising an egg-shaped housing and a doll sized to fit within the housing. U.S. Pat. No. 5,224,894, issued to Nelson et al., discloses a doll housed within an invertable container. The containers disclosed by Nelson et al. include a cupcake configuration, a garbage can configuration, and a redwood basket configuration.

Accordingly, there remains an endless need for distinctive fantasy toy dolls to amuse and entertain children while stimulating the imagination.

BRIEF SUMMARY OF THE INVENTION

The present invention comprises a series of brightly colored toy dolls and correspondingly colored egg enclosure for selectively housing the dolls. The toy dolls and egg enclosures are integral elements in a fictional story about the alien world, GAM, as described in a series of literary works that provide background information on an alien world and the inhabitants thereof. According to the legend and fantasy story revealed in the corresponding written materials, the egg-shaped housings provided a transport vehicle in which the alien babies were transported through space from a planet GAM., facing imminent destruction, to Earth. The written materials accompany each toy doll and egg-shaped enclosure and include various certificates whereby purchasers of the dolls may register the purchase and obtain a "birth certificate". In addition, the written materials include colorful illustrations that, in combination with the text, provide information and a fictitious history in the form of childrens' books. The is written materials also include a dictionary, entitled the Gamish Language Dictionary, that allows the user to translate the language spoken by the dolls via speech synthesis electronics.

The present invention primarily relates to functional and ornamental aspects of toy dolls and the egg-shaped enclosures therefor. In the preferred embodiment, the toy dolls generally resemble human babies except that the dolls are brightly colored (e.g. pink, gold, blue, silver, green, etc.) in that the dolls clothing and skin are a uniform single color. In addition, each doll includes a mirror-like reflecting surface affixed to the doll's abdomen region for reasons further discussed herein below. Furthermore, each doll includes speech synthesis electronics that provide the doll with synthesized speech output capability.

The brightly colored dolls are initially housed within correspondingly colored egg-shaped housings that have a removable portion for allowing one to open the egg and remove the doll. According to the legend revealed in the corresponding written materials, the egg-shaped housings provided the vehicle in which the alien babies were transported through space from the planet GAM to Earth.

DETAILED DESCRIPTION OF THE INVENTION

Figure 2:
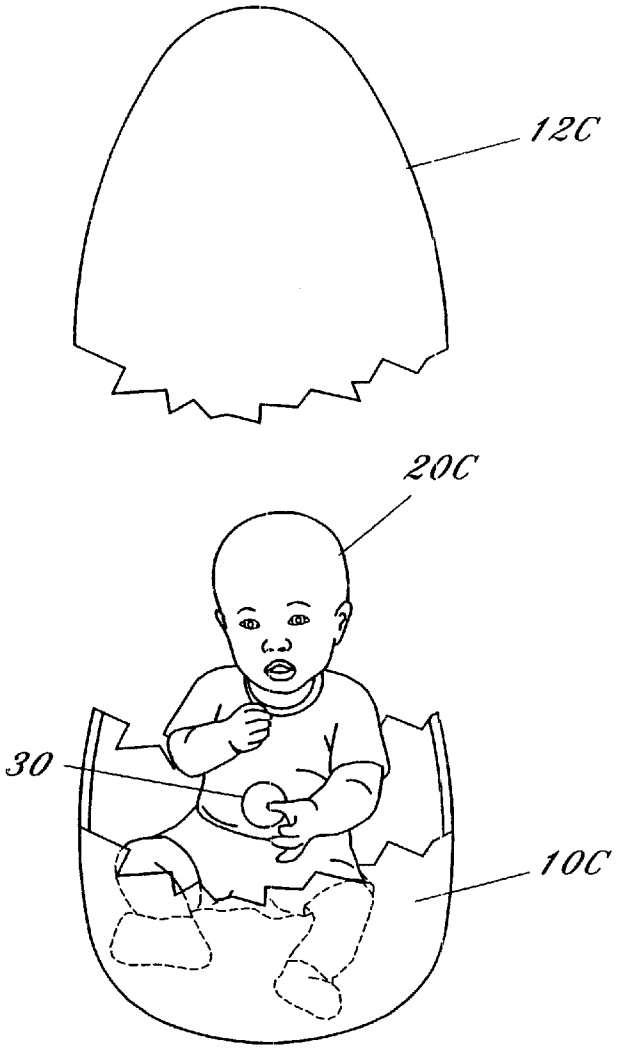
FIG. 2 is a partial exploded view of the toy doll and egg-shaped enclosure depicting the toy doll partially disposed within the enclosure.
Figure 1:
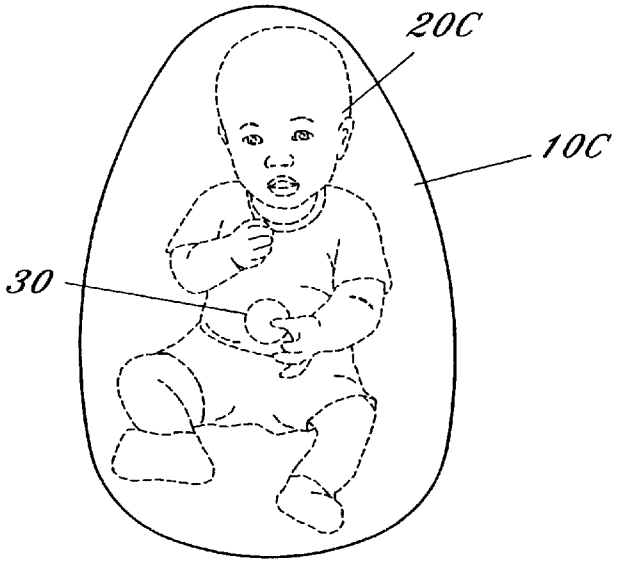
FIG. 1 depicts a toy doll and egg-shaped enclosure according to the present invention.
Figure 3:
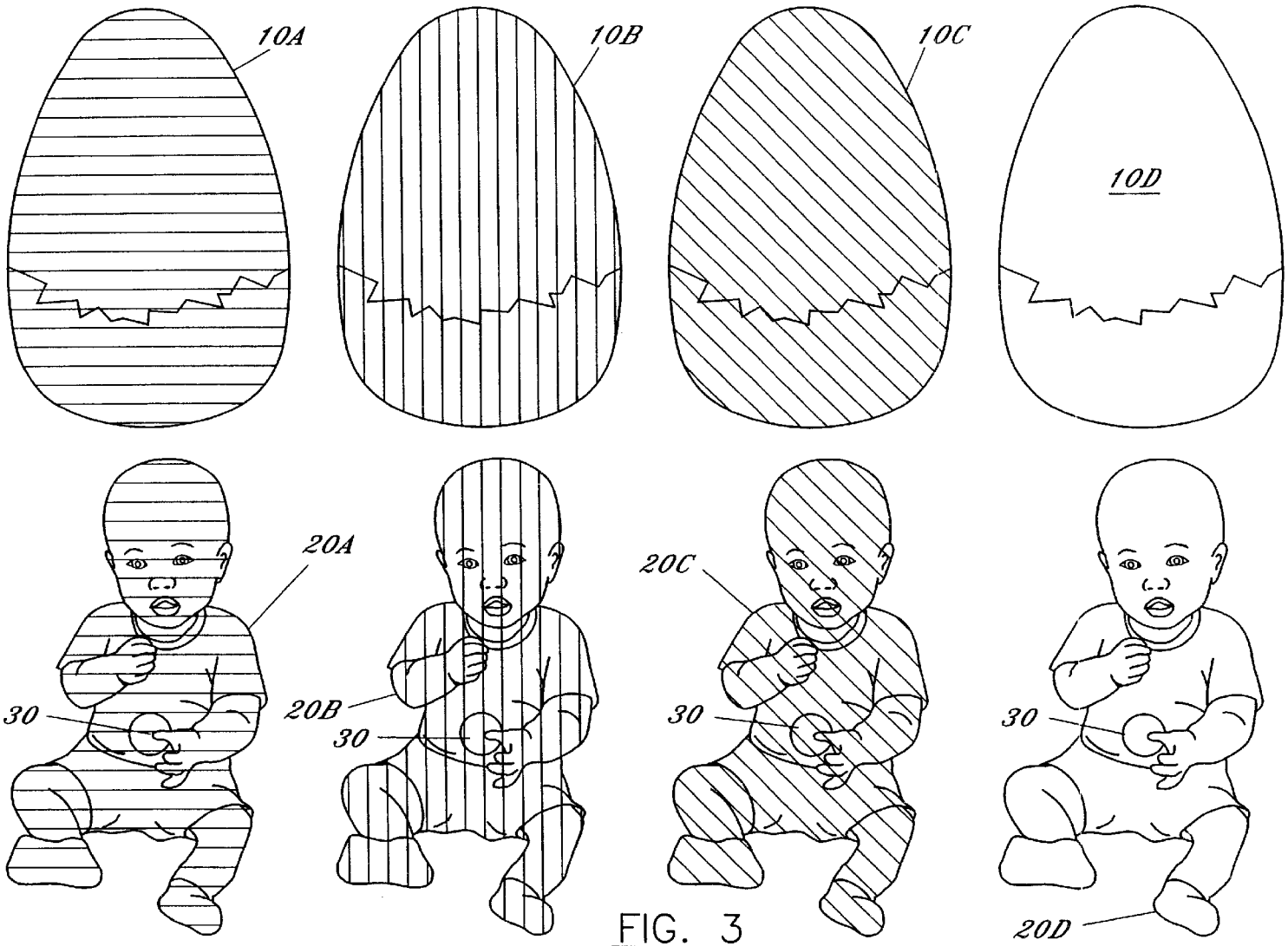
FIG. 3 depicts a plurality of toy dolls and corresponding egg-shaped enclosures.

With reference now to the drawings there is disclosed a preferred embodiment of the present invention. FIGS. 1 through 3 depict toy dolls and egg-shaped doll enclosures according to a preferred embodiment of the present invention. FIG. 1 depicts an egg-shaped enclosure 10 housing a toy doll 20 therein. FIG. 2 is an exploded view depicting the egg-shaped enclosure in an open configuration wherein a removable top portion thereof, referenced as 12 has been removed to reveal the toy doll 20 housed therein. FIG. 3 depicts egg-shaped containers, referenced as 10A, 10B, 10C, and 10D, representing a selection of the various colors, such as pink, silver, green, and gold, used in connection with the present invention, and further depicts the correspondingly colored dolls, 20A through 20D. Each egg-shaped container includes a main body portion, generally referenced as 10, and a removable top portion, generally referenced as 12. Each egg-shaped container 10, is preferably molded from impact resistant plastic, and structured such that removable portion 12 may be matingly joined with body portion 10 and sized to accommodate a correspondingly colored toy doll therein as shown in FIG. 1.

As discussed hereinabove, the toy doll 20 and egg-shaped enclosure 10 are integral elements described in a fictional story about an alien world, namely planet GAM, as described in a series of literary works that provide background information for the user regarding a fictional alien world and the inhabitants thereof. According to the fictional story revealed in the corresponding written materials, the egg-shaped housings provided the space vehicles in which the alien babies were transported from the fictional planet GAM to Earth. The written materials included with each toy doll and egg not only include a fictional account and background information about the alien world of GAM, but also include various certificates whereby purchasers of the dolls may register the purchase with the manufacturer and obtain a personalized "birth certificate" indicating such information as the "birth date" (e.g. date of purchase) and "name".

The present invention primarily relates to the structural, functional and ornamental aspects of toy dolls and the egg enclosures. As best seen in FIGS. 1 through 3, dolls 20 generally resemble human infants except that the dolls are brightly colored (e.g. pink, gold, blue, silver, green, etc.) in distinct colors that are distinguishable from the skin colors of humans from around the world. In addition, each doll includes a reflecting surface 30, such as a mirror or polished metal, affixed to each doll's abdomen region. In a preferred embodiment, reflecting surface 30 is round, however, in alternate embodiments, reflecting surface 30 may be square, triangular, or any other suitable geometric shape. Reflecting surface 30 enables the user to view reflected images. As should be apparent, reflecting surface 30 may comprise a mirror or any other suitable reflecting material, such as polished metal or the like.

As best depicted in FIGS. 4–8, each doll includes speech synthesis electronics, disposed internally therein, that provides the doll with synthesized speech output capability for the amusement of the user. The synthesized speech is facilitated by system components including: (1) power-up/hold circuit with voltage regulator; (2) 8-bit microcontroller with software; (3) speech synthesis chip with phrase-storage memory (4 megabit); (4) speaker driver/amplifier chip and speaker. The speech synthesis system components are contained within each toy doll 20 and activated by a switch having a portion thereof connected to reflecting surface 30 which functions as a user activation switch.

Figure 4:
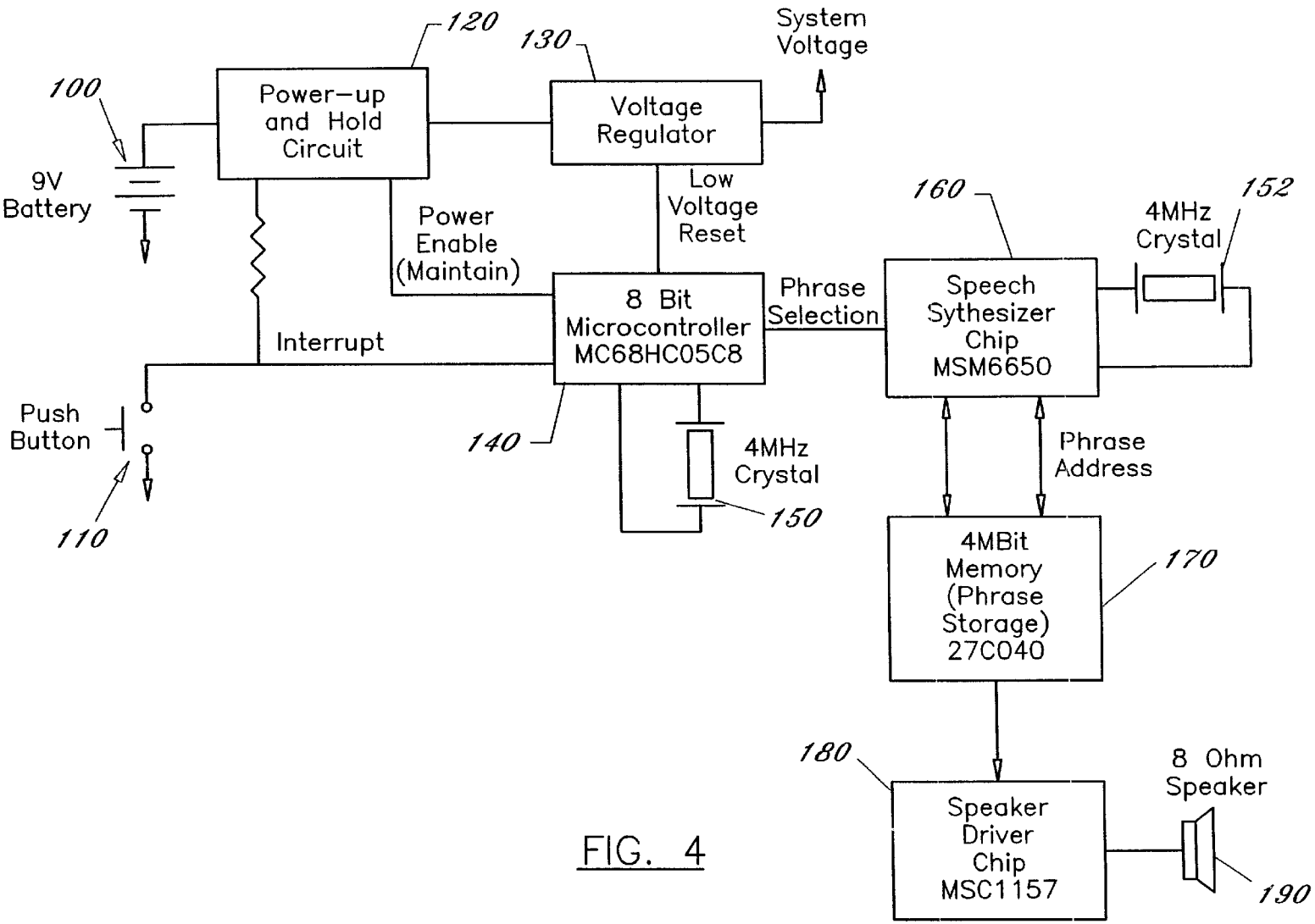
FIG. 4 is a block diagram of the speech synthesis electronics of the present invention.
Figure 5:
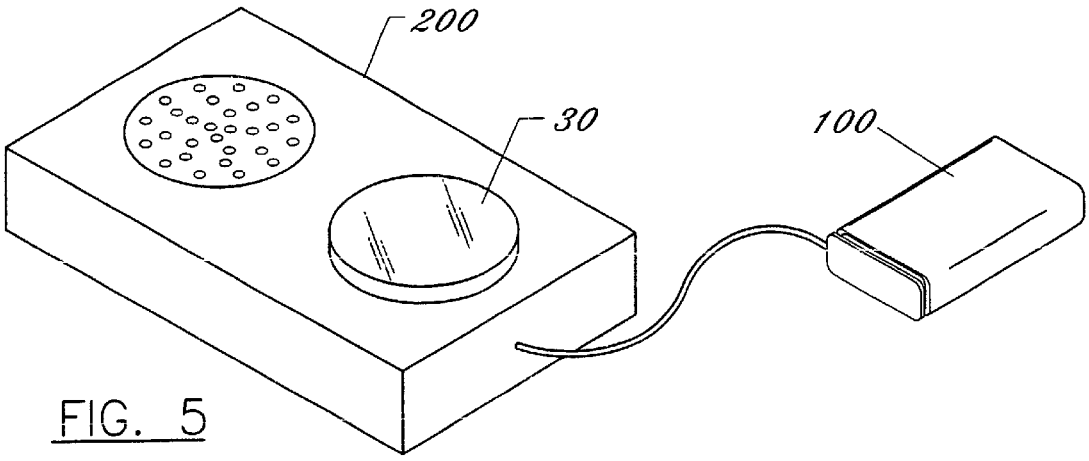
FIG. 5 is a perspective view of a housing for the speech synthesis electronics and associated battery source.
Figure 6:
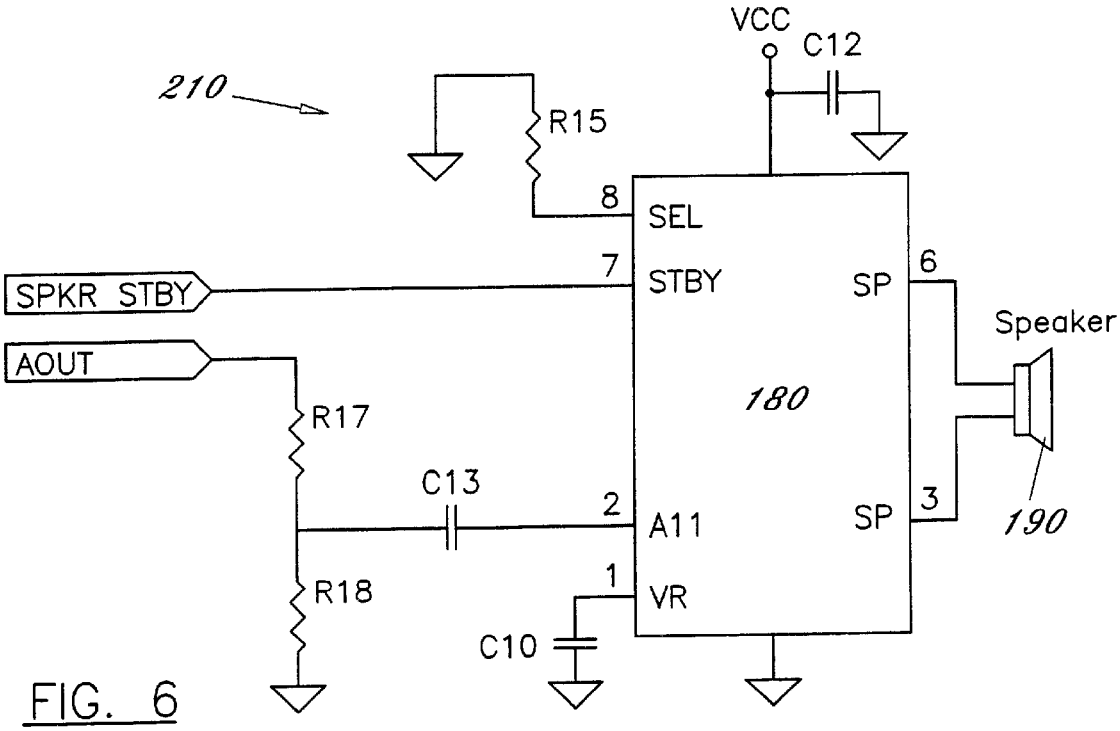
FIG. 6 is an electrical schematic of the speaker amplifier circuit.
Figure 7:
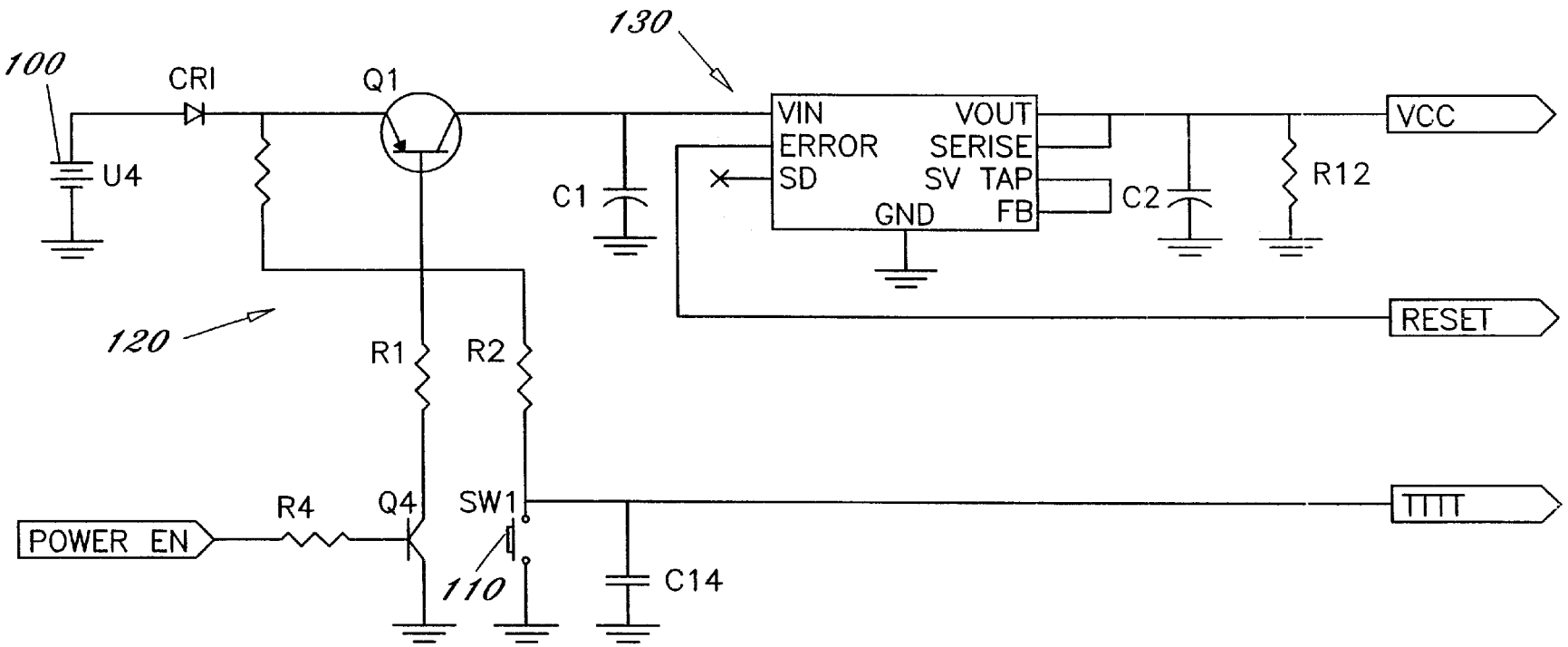
FIG. 7 is an electrical schematic of the power-up circuit and voltage regulator circuit.
Figure 8A:
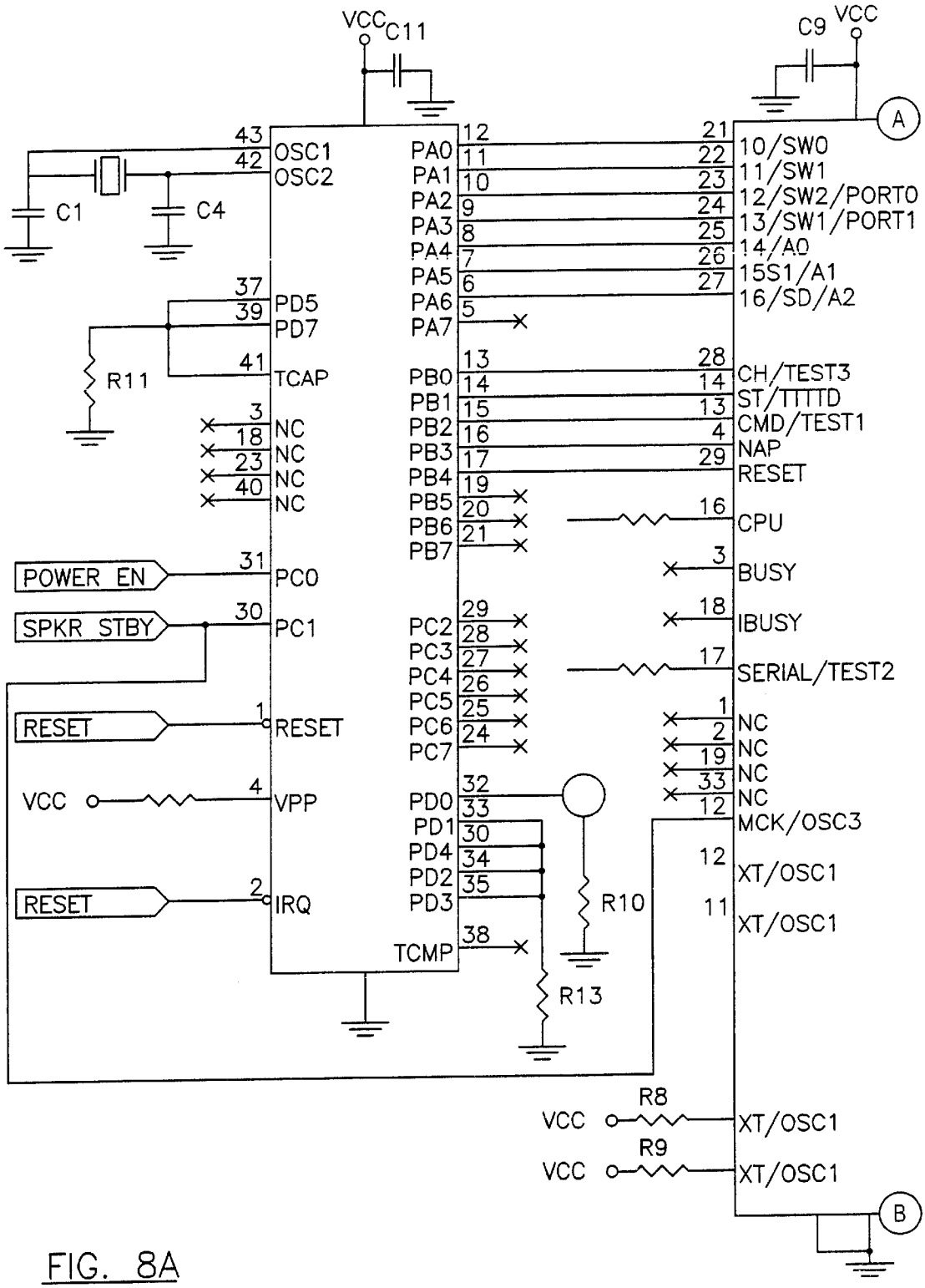
FIGS. 8A–8B are an electrical schematic of the microprocessor, speech chip, and memory module according to the present invention.
Figure 8B:
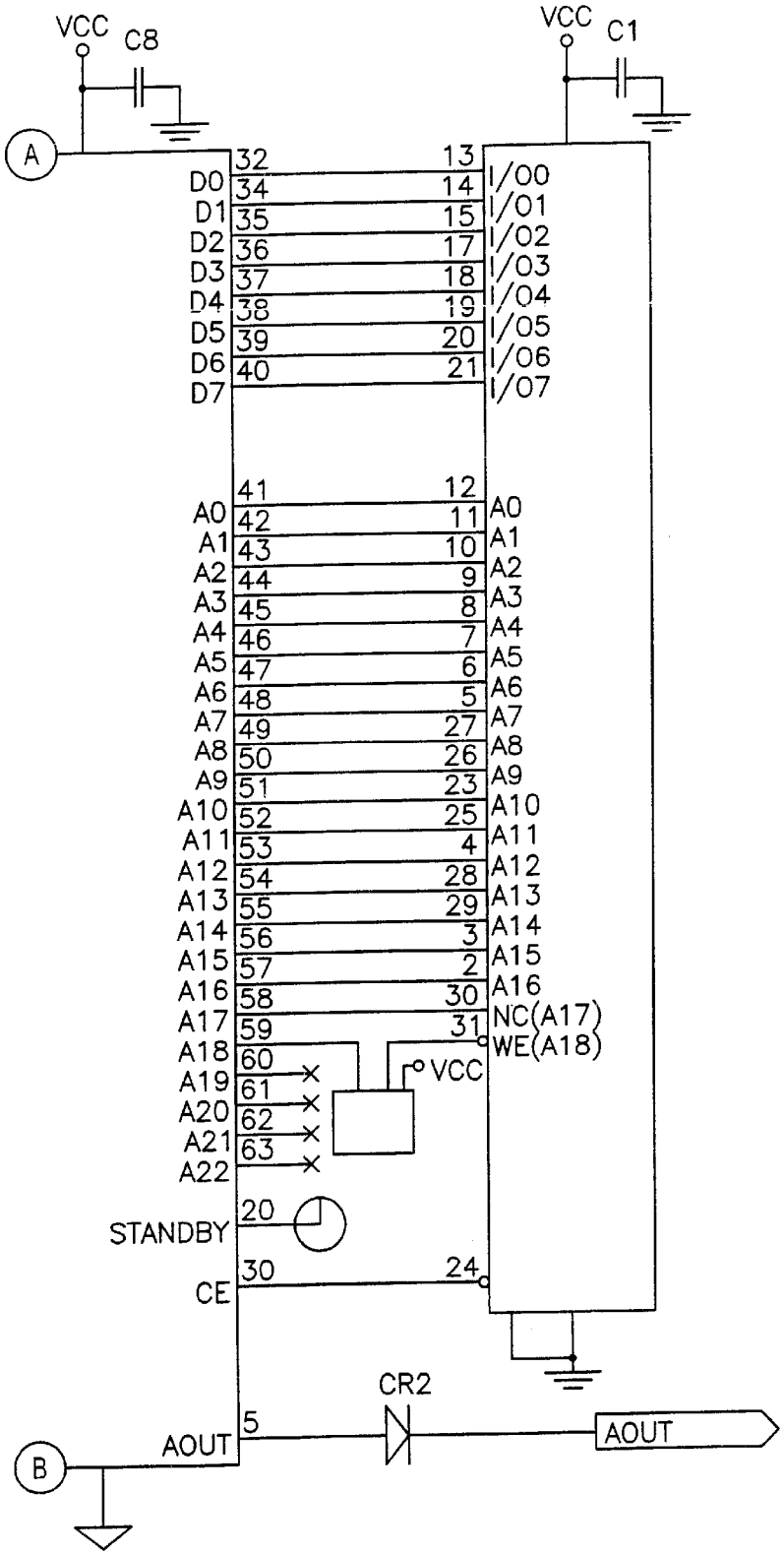

FIG. 4. depicts a component block diagram of the speech synthesis hardware which includes a battery power source 100, push button activation switch 110, power-up and hold circuit 120, voltage regulator 130, 8-Bit microprocessor 140, 4 MHz crystals 150 and 152, speech synthesizer chip 160, 4 megs of memory 170, speaker driver 180, and speaker 190. As best depicted in FIG. 5, the components are housed within the toy doll in an electrical housing 200. FIG. 6 depicts a schematic of the speaker amplifier circuit, generally referenced as 210 and including a speaker driver chip 180 and speaker 190. FIG. 7 provides a more detailed schematic illustration of the power-up circuit 120 and voltage regulator 130. FIG. 8 provides a schematic illustration of the electrical connections for microprocessor 140, speech chip 160, and memory chip170.

The following describes the speech synthesis system operation. The speech synthesis components are inactive until the user applies a force to the reflecting surface 30 which is connected to the speech synthesis components and functions as a push-button actuator. The push-button input causes the power-up and hold circuit to "wake-up" the electronics by supplying power and effectively electrically connecting battery 100 to the speech synthesis circuitry, and more directly to the power-up and hold circuit 120. In the "wake-up" mode, the electronics maintains or holds the power-up/hold circuit in the enabled state so the system does not lose its power once the push button is released. Microcontroller 140 then activates a "power enable" routine, whereby it proceeds to "randomly" select one of a number of prerecorded and digitally stored speech messages and/or phrases. The selected phrase is retrieved from memory 170 and is communicated to the speech synthesis chip 160 which reads the selected phrase from memory chip (phrase storage) one-bit-at-a-time in an Adaptive Differential Pulse Code Modulation (ADPEM) decoding process. As the speech synthesis chip reads and decodes the phrase from memory, it produces an analog version of the phrase and supplies it to the speaker driver chip. Thus, the phrase is produced as audio output from the speaker, whereby the toy doll appears to speak.

Each time the user actuates the push-button input (i.e. reflecting surface 30) a randomly selected phrase is spoken and a delay timer is re-started, which lasts for approximately 10 seconds. If the delay timer expires before another push-button input occurs, the microcontroller "disables" the power-up/hold circuit and as a result, the system powers-down by effectively disconnecting the battery.

It should be noted that the exact process used by the MSM6650 speech synthesis chip in "encoding" and "decoding" the phrases into a file which can be "programmed" into a suitable memory chip, such as the MSM6650 chip manufactured by OKI Semiconductor, Inc. Although the process is the well-known 4 -bit ADPCM process in general, the details of the specific process used in the MSM6650 are not disclosed by OKI Semiconductor.

There are preferably three (3) versions of speech synthesis phrases, generally referenced as phases I, II, and III, of the speech synthesis electronics and software in a preferred embodiment of the present invention. The phases differ only in the number of random phrases stored and available for output in each phase/version. Phase I preferably includes 6 phrases, randomly spoken. Phase II preferably includes 11 phrases (comprising the 6 phrases from phase I, plus 5 additional phrases), each randomly spoken. Phase III includes 17 phrases (including 11 phrases from phase II, plus 6 additional phrases) each randomly spoken. All three phases use the same circuitry, but different software and different memory chip files.

The software is preferably written in a high-level language, such as "C-Language" in a modular fashion, as opposed to one large file. This allows for clearer documentation and a more orderly structure. Unlike the encoding process in the memory chip the software resides in the microcontroller and was written specifically for this application.

The three (3) phases of the preferred embodiment are as follows:

| Audio Output | (Translation) |
|---|---|
| PHASE I | |
| Alagosee | (I want to play) |
| Fee-Fee | (I'm hungry) |
| La-La | (Mommy) |
| Oshdapoo | (I love you) |
| Pepee | (Daddy) |
| Tow-May | (Hug me) |
| PHASE II | |
| Here Cupee-Cupee | Cupee = Cat |
| Gamlet Cute | Gamlet = Pig |
| My Ogdoo | Ogdoo = Dog |
| Daba So Silly | Daba = Bird |
| RaRa Happy | RaRa = Rabbit |
| +Phase I phrases | |
| PHASE III | |
| Koolee Please | Koolee = soda |
| I want my gongie | Gongie = blanket |
| Ziplees, bye bye | Ziplee = automobile |
| I love gambees | Gambee = hamburger |
| Fla-Fla too hot | Fla-Fla = French Fry |
| Pop-Pops are Yumee | Pop-Pop = Hot Dog |
| +Phase I and II phrases | |

The 4 megabit memory chip 170 holds up to a total of approximately 60 seconds of speech, using 16 kHz, 4 -bit ADPCM encoding. Phase III (which is the largest version) consumes approximately 50 seconds of the available 60 seconds of memory space. Each toy doll will include one of the disclosed Phase I, II, or III capabilities thereby providing the user with dolls at different levels of simulated speech development for enhanced enjoyment and amusement.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What is claimed is:

1. A toy doll capable of playing programmed speech phrases, comprising:

a doll body, said doll body including a head, arms, legs and a torso, said doll body being of a uniform color;

data storage means disposed within said doll body for storing a plurality of recorded audible speech phrases which phrases are combined to provide different phases of simulated speech development, said plurality of recorded phrases selected from the group consisting of a first set of phrases, a second set of phrases including said first set of phrases plus additional phrases, and a third set of phrases including said second set of phrases plus additional phrases, thereby providing a doll with one of said three possible sets of phrases corresponding to different phases of simulated speech development, said first set of phrases corresponding to a first phase of speech development, said second set of phrases corresponding to a second phase of speech development, and said third set of phrases corresponding to a third phase of speech development;

audio output means including speaker means disposed within said doll body for selectively playing said audible speech phrases;

processor control means for randomly selecting one of said plurality of recorded phrases, said processor control means electrically connected to each of said data storage means and said audio output means, said processor control means including means for randomly selecting one of said plurality of prerecorded audible speech phrases upon activation;

a power supply electrically connected to said processor control means;

a manual switch connected to said processor control means, said manual switch having a portion thereof projecting from said doll body, said manual switch functioning to selectively activate said processor control means whereby activation of said processor control means causes the random selection and playing of at least one of said plurality of speech phrases;

a reflecting surface disposed externally adjacent and proximate the torso of said doll body, said reflecting surface connected to said manual switch;

an openable and closeable enclosure defining an interior volume for removably housing said doll body, said enclosure having an external surface of a uniform color substantially similar to the uniform color of said doll body.

2. A toy doll capable of playing preprogrammed speech according to claim 1, wherein said enclosure is egg-shaped.

3. A toy doll capable of playing preprogrammed speech according to claim 2, wherein said prerecorded phrases include nonsensical phonetic sounds alone and in combination with actual words.

4. A toy doll capable of playing preprogrammed speech according to claim 1, further including written materials including fictional background information describing the toy doll as originating from an alien world.

5. A toy doll capable of playing programmed speech phrases, comprising:

a doll body, said doll body including a head, arms, legs and a torso, said doll being brightly colored of a color selected from the group consisting of red, orange, yellow, green, blue, indigo, violet, silver, gold, and pink;

electronic data storage memory chip disposed within said doll body, said memory chip storing a plurality of audible speech phrases, said plurality of speech phrases selected from the group consisting of a first set of phrases, a second set of phrases including said first set of phrases plus additional phrases, and a third set of phrases including said second set of phrases plus additional phrases;

said first set of phrases corresponding to a first phase of speech development, said second set of phrases corresponding to a second phase of speech development, and said third set of phrases corresponding to a third phase of speech development;

at least one audio output speaker disposed within said doll body for playing said audible speech phrases;

a microprocessor disposed within said doll body, said microprocessor electrically connected to each of said memory chip and said audio output speaker, said processor control means including random selection means for randomly selecting one of said plurality of audible speech phrases;

a power supply electrically connected to said microprocessor;

a manual switch connected to said microprocessor, said manual switch having a portion thereof projecting from said doll body, said manual switch functioning to selectively activate said microprocessor whereby activation of said microprocessor causes the random selection and playing of at least one of said plurality of audible speech phrases;

a reflecting surface disposed externally adjacent and proximate to the torso of said doll body, said reflecting surface connected to said manual switch, whereby a force applied to said reflecting surface actuates said manual switch thereby causing said microprocessor to randomly select and play one of said plurality of audible speech phrases;

an egg-shaped enclosure defining an interior volume for housing said doll body, said enclosure having an external surface of a uniform color matching the uniform color of said doll body, said egg-shaped enclosure having a removable portion thereof for facilitating insertion and removal of said doll body.

6. A toy doll capable of playing preprogrammed speech according to claim 5, wherein said prerecorded phrases include nonsensical phonetic sounds alone and in combination with actual words.

7. A toy doll capable of playing preprogrammed speech according to claim 5, further including written materials including fictional background information describing the toy doll as originating from an alien word.

* * * * *